US005316050A

United States Patent [19]

Bertsch

[11] Patent Number: 5,316,050

[45] Date of Patent: May 31, 1994

[54] AIR-OPERATED SELVAGE LAYING EQUIPMENT FOR LOOMS

[75] Inventor: Gotthilf Bertsch, Ebnat-Kappel, Switzerland

[73] Assignee: Gebrueder Sulzer Aktiengesllschaft, Winterthur, Switzerland

[21] Appl. No.: 35,855

[22] Filed: Mar. 23, 1993

[30] Foreign Application Priority Data

Mar. 26, 1992 [EP] European Pat. Off. ..... 92810224.3

[51] Int. Cl.[5] ..... D03D 47/48

[52] U.S. Cl. ..... 139/434

[58] Field of Search ..... 139/434, 430

[56] References Cited

U.S. PATENT DOCUMENTS 4,552,187 11/1985 Bertsch et al. ..... 139/434
4,565,225 1/1986 Bertsch ..... 139/434

FOREIGN PATENT DOCUMENTS 0134377 3/1985 European Pat. Off. .
0149969 7/1985 European Pat. Off. .
0349039 1/1990 European Pat. Off. ..... 139/434
0351361 1/1990 European Pat. Off. .
0483067 10/1991 European Pat. Off. ..... 139/434

*Primary Examiner*—Andrew M. Falik
*Attorney, Agent, or Firm*—Townsend and Townsend Khourie and Crew

[57] ABSTRACT

In a selvage laying equipment a catcher nozzle (44) with a catcher channel (45) lying in axial prolongation of the nozzle and a threader nozzle (41) with a catcher channel (42) lying in axial prolongation of the nozzle are arranged in a carrier (54) with the axes of their air jets crossing one another, which enables a narrow construction of the device for threading the end (21*a*) of the weft yarn into the eye or hook of the selvage laying needle (11) and hence short ends (21*a*) to the weft yarn and narrow selvages, respectively. Bits of dirt such as fluff are reliably carried away from the gap (55) in the carrier (54) as well as from the catcher channels (42, 45) and the formation of an air dam is prevented.

15 Claims, 3 Drawing Sheets

AIR-OPERATED SELVAGE LAYING EQUIPMENT FOR LOOMS

BACKGROUND OF THE INVENTION

The invention refers to an equipment for looms.

From the O/S EP-0-149-969 an air-operated selvage laying equipment is known which holds the end of the weft yarn temporarily by a catcher nozzle until it is blown by means of a threader nozzle through the eye of a selvage laying needle. Thereupon the end of the weft yarn is inserted in the shed by the selvage laying needle.

The arrangement of catcher nozzle and threader nozzle off-set in parallel with respect to the longitudinal axis of the nozzles as disclosed in that case, has the disadvantage that a relatively long end of weft yarn is necessary for secure threading into the eye, the consequence of which is a relatively wide selvage. This arrangement of the nozzles requires in addition in a relatively heavy nozzle carrier. A further arrangement disclosed in the same document, with nozzles arranged directly one above the other on the same axis, allows shorter ends to the weft yarn, though the disadvantage persists that both of the two nozzles carry dirt onto the catcher channel placed in each case in front of the companion nozzle, which cannot be eliminated during operation of the loom. The dam which forms against the air can impede secure threading of the weft yarn end.

SUMMARY OF THE INVENTION

The problem underlying the invention is to create an equipment improved as regards this aspect.

Selvage laying equipment constructed according to the invention has a catcher nozzle in axial alignment with a catcher channel and a threader nozzle in axial alignment with a catcher channel. They are arranged on a carrier so that the axes of their air jets cross one another. A narrow construction of the device for threading the end of the weft yarn into the eye or hook of the selvage laying needle and hence, short weft yarn ends and narrow selvages are thereby made possible. Bits of dirt such as fluff are reliably carried away from the gap in the carrier as well as from the catcher channels and the formation of an air dam is prevented. The compact arrangement allows the mass of the nozzles and carrier to be reduced so that can be more rapidly moved. the carrier more rapid movements are

DESCRIPTION OF THE PREFERRED EMBODIMENTS

Figure 1:
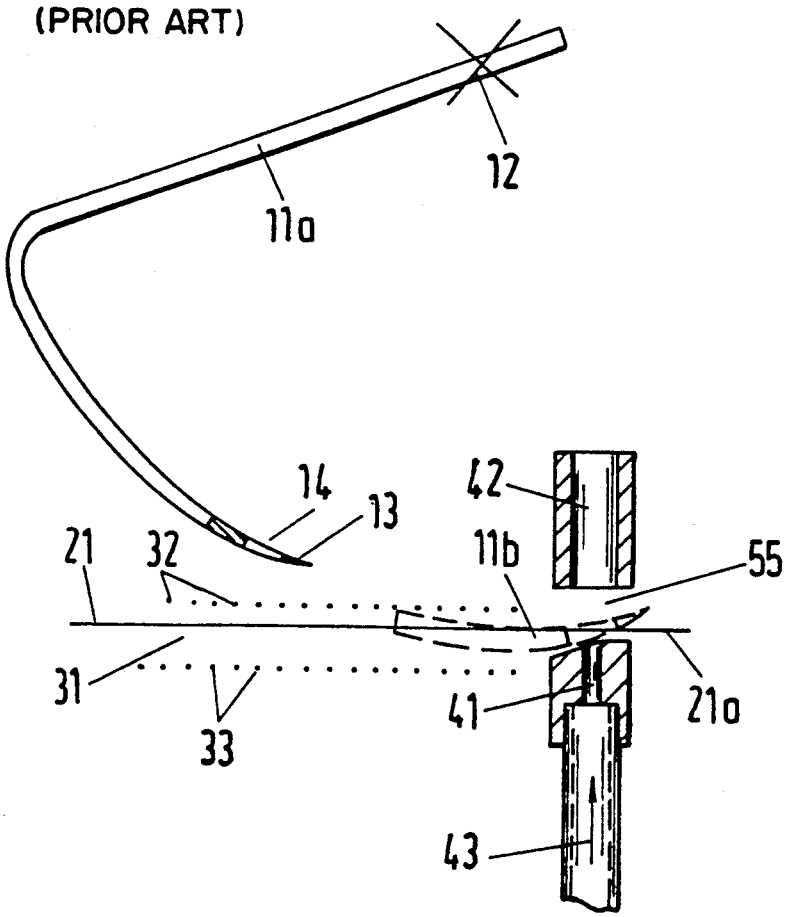
Fig.1 (PRIOR ART)
FIG. 1 is an elevation, partially in section, of the essential components of an air-operated selvage laying equipment.

A shed 31 is formed by upper shed warp threads 32 and lower shed warp threads 33, into which a weft yarn 21 is inserted. Edge warp threads or respectively a holder nozzle for holding the weft yarn or respectively the end of the weft yarn until the cutting and threading-in process are not shown in FIG. 1. A selvage laying needle 11*a* has a tip 13 and an eye 14, is able to turn about the center 12, and can be introduced into the shed 31 as indicated by the position of the selvage laying needle 11*b*. The eye 14 may also be made open at one side as a hook. For the sake of clarity only the threader nozzle 41 with the fluid line 43 and catcher channel 42 lying axially opposite the threader nozzle 41 are shown. The end 21*a* of weft yarn resulting after the cutting process is blown by the threader nozzle 41, with a flow of fluid in fluid line 43, such an air, through the eye in the selvage laying needle 11*b* and into the catcher channel 42.

Figure 2A:
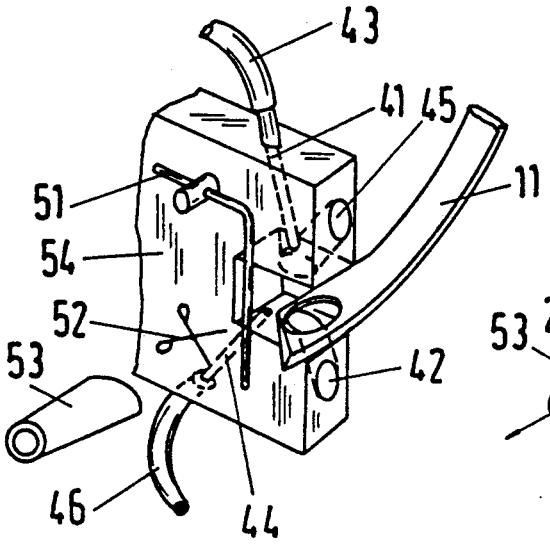
FIG. 2*a* is a partial perspective view of the nozzle arrangement and associated details of a further air-operated selvage laying equipment.
Figure 2B:
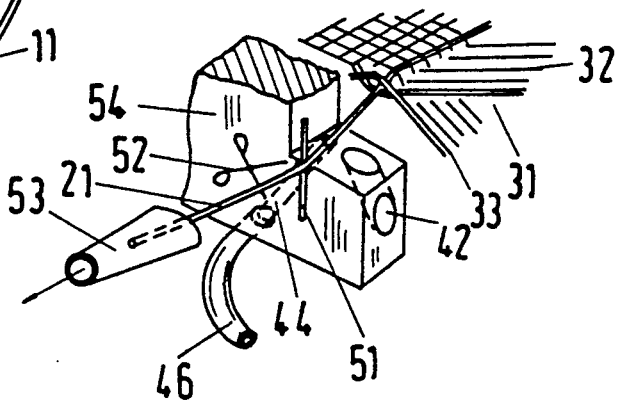
FIGS. 2*b*–2*d* are perspective views which illustrate the procedure of threading in the weft yarn.

FIG. 2*a* shows in detail those elements of a further air-operated selvage laying equipment which are of importance for the process of threading the end of the weft yarn into the eye of the selvage laying needle 11. In this embodiment of the selvage layer a holder nozzle 53 is positioned at the edge of the weave at the end of the weft insertion as is customary. The carrier 54 is usually supported to be able to swing or shift in the direction of the warp, so that after the insertion process all of the elements fastened to it may be moved away in order, for example, not to impede the beat-up of the reed. The threader nozzle 41, the associated, axially aligned catcher channel 42 and the catcher nozzle 44 with the associated, axially aligned catcher channel 45 are arranged on the carrier 54 with the axes of their air jets crossing one another. The axes of the air jets crossing one another may intersect in space or else be arranged to cross over in such a way that only the projection of the spatial axes onto one plane gives an intersecting crossing. The selvage laying needle 11 is likewise shown, into the eye of which the weft yarn is threaded. Edge warp yarns or, a holder nozzle 53, for example, hold the weft yarn 21 until it is cut by a yarn shear 52. To position the weft yarn 21 exactly above the outlet from the catcher nozzle 44 after the beat-up of the weft, a yarn positioning wire 51 is provided on carrier 54 to determine the position of the weft yarn 21 in a gap 55 on the carrier 54. A weft yarn 21 positioned in that way and held by the holder nozzle 53 is shown in FIG. 2*b*. The shed 31 with the upper shed warp threads 32 and lower shed warp threads 33 may likewise be seen. The weft yarn 21 which has previously been beaten up by the reed is bound into the fabric by the crossing of the warp threads or by the change of shed.

Figure 2C:
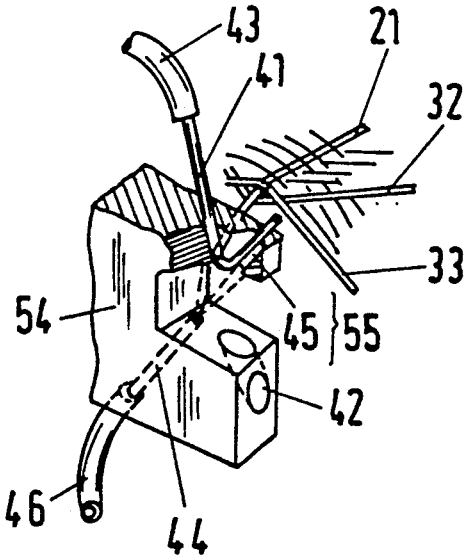
Figure 2D:
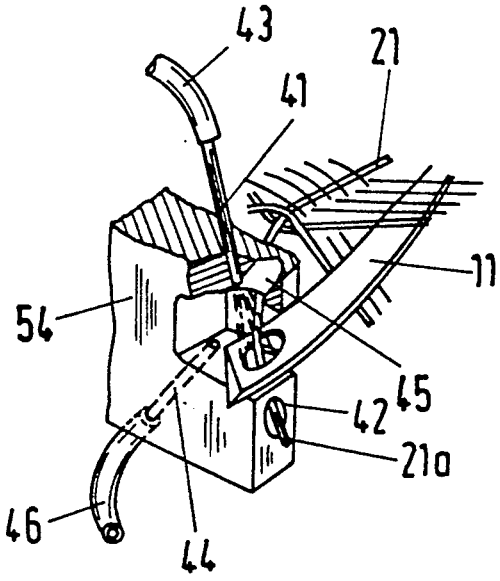

As shown in FIG. 2*c*, catcher nozzle 44 is charged with air, the weft yarn 21 is cut by yarn shear 52 and the end of the weft yarn is blown into the catcher channel 45. In doing so a piece of the end of the weft yarn comes to lie in front of the outlet from the threader nozzle 41. Thereafter selvage laying needle 11 is swung into the gap 55 on the carrier 54 in such a way that the eye 14 is positioned over the opening of the catcher channel 42. By activating threader nozzle 41, as shown in FIG. 2*d*, the resulting air flow pulls end 21*a* of the weft yarn out of the catcher channel 45 and blows it via the eye 14 into catcher channel 42. The end of the weft yarn is thereupon inserted by the selvage laying needle 11 into the shed 31 and hence forms the selvage.

The positions of the upper shed warp threads 32 and lower shed warp threads 33 of the shed 31 are always shown in the same position in FIGS. *2b–2d*. The position of the warp threads or of the shed 31 can of course be altered during the cutting and insertion process.

The selvage laying equipment of the present invention may be operated not only with air but also with other fluids such, as water, for example.

Figure 3:
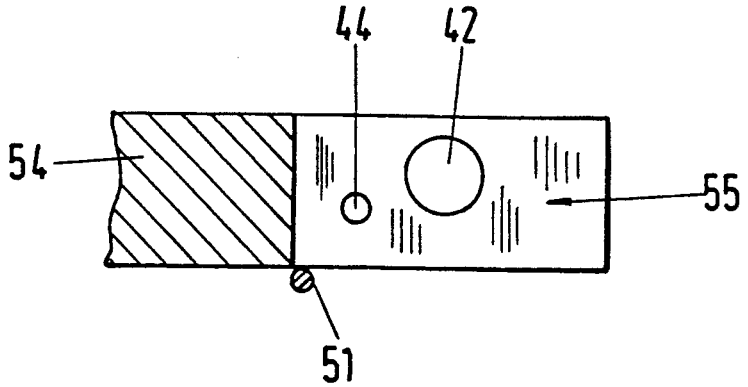
FIG. 3 is a fragmentary plan view which shows an arrangement of a nozzle and a catcher channel in the carrier.

FIG. 3 shows a plan of the gap 55 in the carrier 54 as well as the arrangement of the yarn positioning wire 51, the opening of the catcher nozzle 44 and the opening of the catcher channel 42. The openings 42 and 44 are preferably arranged in parallel or approximately in parallel with the run of the warp threads in order to achieve short ends of the weft yarn. The positions of the opening of the catcher nozzle 44 and of the threader nozzle 41 are preferably chosen so that the end 21*a* of the weft yarn which is to be delivered comes to lie in the air jet from the nozzle. Each of the axes of the air jets crossing one another from the two nozzles 41 and 44 may lie in a plane parallel with the direction of the warp threads, in a plane parallel with the direction of insertion of the weft yarn 21 or in a plane in a range intermediate between these two positions. The inlet openings of catcher channels 42 and 45 are usually axially aligned with the opposite nozzles, though the continuation of the catcher channels may be straight or curved.

The arrangement of the two nozzles 41 and 44 as shown in FIGS. *2a–2d* may also be mutually exchanged so that the catcher nozzle 44 comes to lie above and the threader nozzle 41 to lie below.

Figure 4:
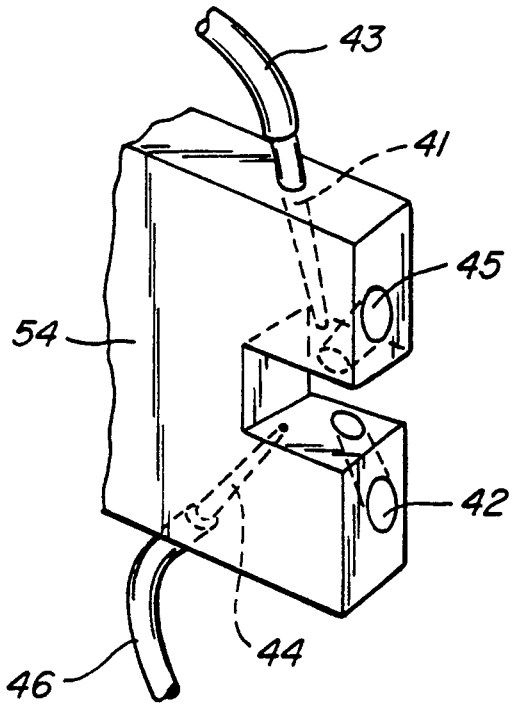
FIG. 4 is a partial perspective view similar to FIG. 2 and illustrates the positioning of the air nozzles and thread catching channels in a common plane.
Figure 5:
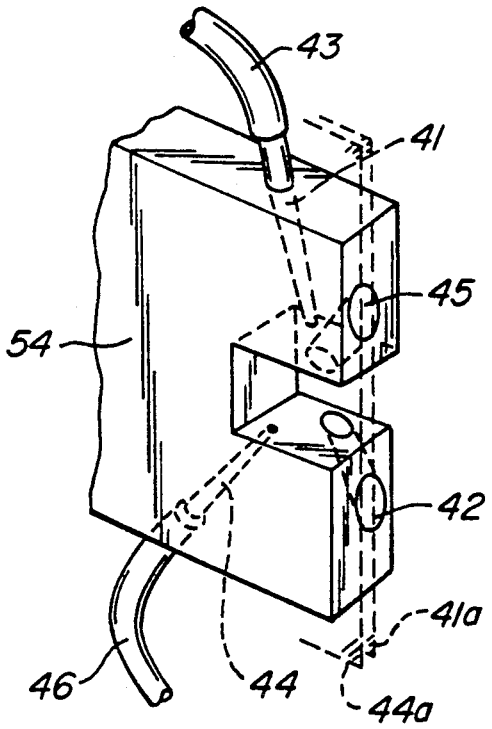
FIG. 5 is a perspective view similar to FIG. 4 and illustrates the positioning of the cooperating airstream nozzles and catching channels in two parallel, spaced-apart planes.

As shown in FIG. 4, in one embodiment of the invention the two nozzles 41, 44 and the associated catcher channels 42, 45 lie in a common plane. In an alternative embodiment, illustrated in FIG. 5, the two nozzles 41 and 44, and their associated catcher channels 42, 45, respectively, are located in two spaced-apart planes schematically illustrated by dotted lines 41*a* and 44*a*.

What is claimed is:

1. An air-operated selvage laying equipment for looms, having a selvage laying needle (11) for laying an end (21*a*) of a weft yarn lying outside a shed (31) into a following shed, a catcher nozzle (44) acting upon the weft yarn (21) for securing the end (21*a*) of the weft yarn and a threader nozzle (41) for threading the end (21*a*) of the weft yarn into the eye of the selvage laying needle (11), a catcher channel being arranged coaxially with the nozzle and on an opposite side of a gap on a carrier (54), a first axis of an airstream from the catcher nozzle (44) to an associated catcher channel (45) and a second axis of a further airstream from the threader nozzle (41) to an associated catcher channel (42) crossing over one another.

2. An air-operated selvage laying equipment as in claim 1, wherein the first and second axes of the airstreams lie in one plane.

3. An air-operated selvage laying equipment as in claim 1, wherein the first and second axes of the airstreams lie in two spaced-apart parallel planes.

4. An air-operated selvage laying equipment as in claim 1, wherein openings of the two catcher channels (42, 45), which lie in the gap (55) in the carrier (54) lie opposite one another.

5. An air-operated selvage forming apparatus for use on looms with a selvage laying needle having a yarn receiving opening, the apparatus comprising a carrier body including a gap in the body defined by spaced-apart surfaces, the gap being adapted to receive said needle therein, and fluid jet operated means for threading a yarn disposed in the gap into the needle, the jet operated means comprising first and second sets of fluid discharge nozzles and cooperating fluid stream receiving channels for flowing first and second fluid streams between the surfaces through the gap, the nozzles and associated channels being positioned in the gap defining surfaces so that the first and second streams cross each other in the gap and so that a sequential activation of the nozzles with the yarn in the gap causes the threading of the yarn through the needle opening when it is disposed in the gap.

6. Apparatus according to claim 5 wherein the fluid streams lie in a common plane.

7. Apparatus according to claim 5 wherein the fluid streams are disposed in spaced-apart, parallel planes.

8. Apparatus according to claim 5 wherein one nozzle and one receiving channel each are formed in each of the gap defining surfaces.

9. Apparatus according to claim 5 wherein each of the receiving channels terminates in an opening facing the gap, wherein one of the openings is in each gap defining surface, and wherein the openings have a common axis which is perpendicular to the gap defining surfaces so that the openings lie opposite each other.

10. A loom for weaving weft yarns and warp threads into a fabric including a selvage, the loom comprising a selvage laying needle including a yarn receiving opening proximate an end thereof and threading means for threading an end of a weft yarn into the needle opening, the threading means including body means having spaced-apart surfaces defining a gap therebetween into which the selvage laying needle is moved for threading a yarn end into its opening, a catcher nozzle in one of the surfaces and a cooperating catcher channel in another one of the surfaces for moving the weft yarn end with a first fluid stream emanating from the catcher nozzle into the catcher channel, and a threader nozzle in one of the surfaces cooperating with a threader channel in another one of the surfaces for moving the weft yarn end with a fluid stream emanating from the threader nozzle through the needle opening into the threader channel in a second direction which is angularly inclined with respect to the first direction so that the first and second fluid streams cross each other in the gap, whereby the sequential activation of the first and second fluid streams with the needle opening in the gap when the second fluid stream is activated causes the withdrawal of the weft yarn end from the catcher channel and its threading through the needle eye.

11. A loom according to claim 10 wherein the body means comprises a carrier adapted to reciprocate in a direction of the warp yarns towards and away from the selvage of the fabric, and wherein the body means forms part of the carrier.

12. Apparatus according to claim 11 wherein the nozzles and the channels are formed by the carrier and terminate at the spaced-apart surfaces.

13. Apparatus according to claim 12 wherein one of the nozzles and one of the channels is formed in each surface so that associated nozzles and channels for each fluid stream are formed in the spaced-apart surfaces.

14. A loom according to claim 12 wherein the first and second fluid streams lie in a common plane.

15. Apparatus according to claim 10 wherein the first and second fluid streams lie in parallel, spaced-apart planes.

* * * * *